US006168471B1

(12) United States Patent
Santa Cruz et al.

(10) Patent No.: US 6,168,471 B1
(45) Date of Patent: Jan. 2, 2001

(54) FERRULE-TO-BLADE FUSE ADAPTER WITH A BLOWN FUSE INDICATOR

(76) Inventors: Cathy D. Santa Cruz, 7630 Tholl Dr., Reno, NV (US) 89506; Galen J. May, 2245 Cielo Vista Dr., Sparks, NV (US) 89436

( * ) Notice: Under 35 U.S.C. 154(b), the term of this patent shall be extended for 0 days.

(21) Appl. No.: 09/275,123

(22) Filed: Mar. 24, 1999

Related U.S. Application Data

(60) Provisional application No. 60/080,544, filed on Apr. 3, 1998.

(51) Int. Cl.[7] ..... H01R 13/68

(52) U.S. Cl. ..... 439/621; 439/622

(58) Field of Search ..... 439/622, 621, 439/682; 337/241, 242

*Primary Examiner*—Brian Sircus
*Assistant Examiner*—Chandrika Prasad

(57) ABSTRACT

The present invention is substantially an adapter which allows a typical prior art plug-in type fuse housing to be removably inserted within the adapter, so as the adapter and the plug-in fuse can be inserted within a typical automotive cartridge type fuse box, or the like.

3 Claims, 1 Drawing Sheet

FERRULE-TO-BLADE FUSE ADAPTER WITH A BLOWN FUSE INDICATOR

Note: This utility application corresponds to: Provisional Application No. 60/080,544 filed on Apr. 3, 1998.

FIELD OF THE INVENTION

The present invention relates to fuse adapters that allow a plug-in type fuse housing to be removably inserted within a cartridge-type adapter housing, with the adapter housing having a blown fuse indicator therein.

BACKGROUND OF THE INVENTION

It is well known that there are many different types of fuses available today. For example, older automobiles include a low voltage automotive fuse, typically known as the glass ferrule fuse, or cartridge type fuse, while the newer automobiles include the newer blade-type fuse.

The older ferrule type fuse includes a hollow glass body having a small filament or fuse link that is designed to melt and interrupt the circuit if too much current passes through the fuse. Generally speaking, anyone who has attempted to change a glass ferrule fuse has had a difficult experience. These fuses are difficult to access for several reasons. The fuse box itself may be in a location that is not easily accessible, especially in older cars. In most fuse boxes, the fuses are recessed and difficult to grasp using just the hand.

It is well known that glass is fragile by nature, and a glass ferrule fuse tends to break when incorrectly pried from its socket. A common solution to the problem is the use of a special tool, which can snap onto the body of the fuse and insertion or extraction is obviously facilitated by use of this special tool. However, many car owners do not own this tool, or if they do, they do not carry it in their vehicles, which makes it unavailable if they should need it while on the road.

Other common problems include complaints that the ferrule fuses are not well labeled and that their labels are difficult to read. The applicants have found that some automotive parts stores are discontinuing or are in short supply of the glass ferrule fuses, even in the commonly used amp ratings. So, as a practical matter, the cars that use the older type fuses may outlast the production, or at least the ready supply of the ferrule automotive fuse.

The above problems have necessitated the design of the newer blade-type fuse, which is described in SAE Standard J1284. The automotive blade-type fuse is substantially universal, and the amp rating is printed in bold, easy-to-read letters on the plastic body of the fuse. The blade-type fuse is generally rectangular in shape, having a plastic body and two metal flat prongs or blades protruding from the body which provide the electrical pathway to the fuse filament located within the body of the fuse.

Until the present invention, persons driving older model cars were susceptible to the short supply and rising price of the older glass-type fuse. As nowhere in the prior art did the applicants find an adapter which eliminates the need for the old cartridge type fuse, and which allows a typical blade-type fuse to be functional when combined with the typical ferrule fuse socket. Furthermore, the present adapter not only eliminates the need for a cartridge type fuse, but also provides visual indicating means that notifies the user that the blade-type fuse has blown.

In the past, many attempts have been made to provide identification means to indicate to a user when a fuse has blown. For example, U.S. Pat. Nos. 3,457,535, 4,499,447 and 4,712,081, each provide, a plug-in type fuse housing having a blown fuse indicator therein. However, each are only concerned with the plug-in type fuse housing and none address the cartridge type housing.

It is to be noted that the present applicants have addressed the use of a blown fuse indicator for cartridge type fuses within our U.S. Pat. No. 5,874,884. Wherein, we provide a second barrel-type fuse housing having blown fuse indicating means therein, which is attachable to a prior art type barrel fuse, and we also teach circuitry therefore. Thus, we do not provide or teach the circuitry within this invention, as it is now known and provided within the prior art.

It is to be further noted that the only reference found pertinent to the present invention was U.S. Pat. No. 5,085,600, which teaches an "AUTOMOTIVE BLADE-TO-FERRULE FUSE ADAPTER". This adapter is only functional for replacing the old cartridge type fuses with the preferred plug-in type fuses, and nowhere do they address or even suggest that the adapter may include a blown fuse indicator therein, as clearly taught within the present invention. Furthermore, this device is limited to use with only the standard sized blade-type fuse, unlike the present invention that is functional and attachable to not only the standard sized blade-type fuse, but also the mini-blade-type fuse.

SUMMARY OF THE INVENTION

The present invention allows a user to easily install the adapter within a typical ferrule fuse socket, with the adapter being removably attached to a blade-type fuse, and the adapter includes a blown fuse indicator therein. Whereby, when the blade-type fuse has blown, the indicator lights up and simultaneously illuminates the blade-type fuse housing. Thus, a user is visually notified that the fuse has blown and replacement is necessary.

It is therefore an object of the present invention to provide a new and unusual fuse adapter that is removably attachable to a pre-existing blade-type fuse.

It is a further object of the present invention to provide a fuse adapter that eliminates the need for the old type cartridge fuse.

It is another object of the present invention to provide a fuse adapter that is functional when installed within the typical ferrule fuse socket.

It is a very important object of the present to provide a fuse adapter that includes a blown fuse indicator therein, such as a light source that illuminates when the blade-type fuse has blown.

It is another object of the present invention to provide a fuse adapter that is removably attachable to either a standard sized blade-type fuse, or the mini-blade-type fuse.

Still a further object of the present invention is to provide a fuse adapter which can be made from substantially any suitable material of engineering choice, such as plastic, nylon, hard rubber, wood, or the like.

Yet another object of the present invention is to provide a fuse adapter which can be manufactured in two parts which can be interconnected, if so desired.

Also, another object of the present invention is to provide a fuse adapter that is economical to manufacture and which is easily marketed.

Other objects and advantages will be seen when taken into consideration with the following specifications and drawings.

DETAILED DESCRIPTION OF THE DRAWINGS

Figure 3:
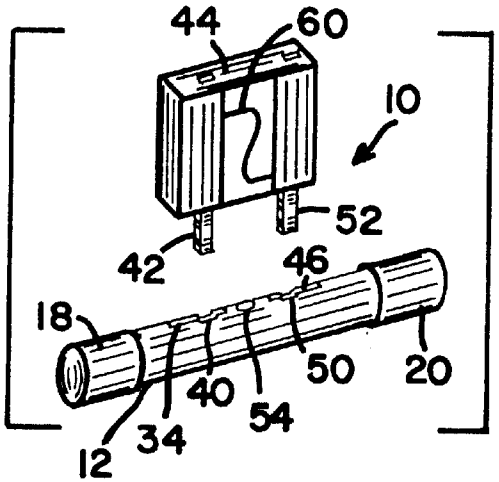
FIG. 3 is substantially a perspective view of a mini-blade-fuse.
Figure 1:
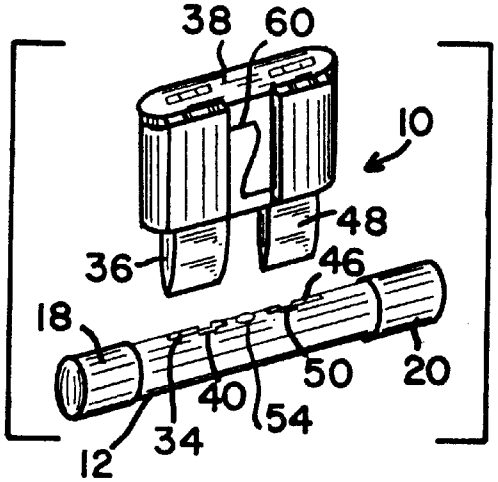
FIG. 1 is substantially a perspective overview of the Present invention.

Referring now to the drawings wherein like characters refer to like elements throughout the various views.

The present device substantially comprises an elongated cartridge-type adapter housing (12), which can be made from substantially any suitable electrical insulating material of engineering choice, such as plastic, ceramic, wood, or the like. It is to be noted that housing (12) can be manufactured in two separate parts, if so desired. With each of the parts having attachment means, which allows them to be snapped together. Or any other suitable attachment means of engineering choice may be used.

Figure 2:
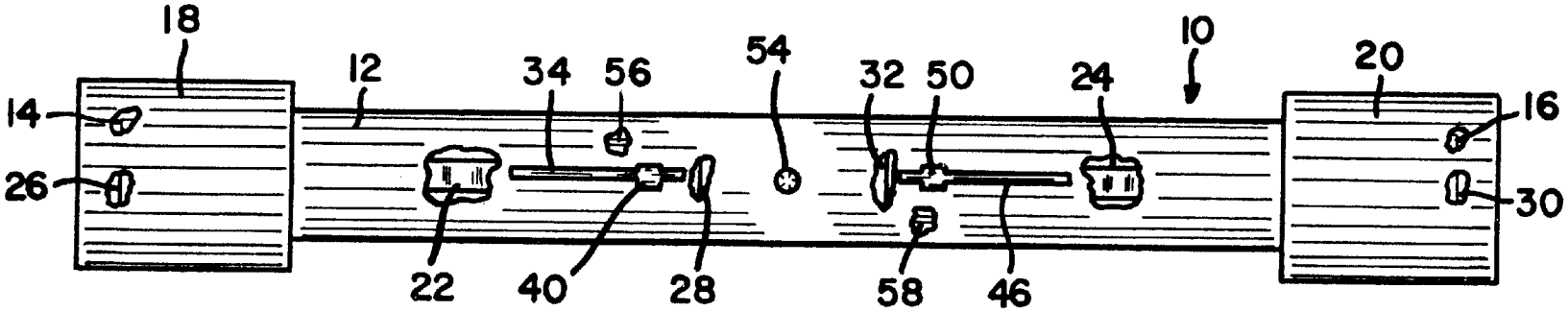
FIG. 2 is substantially a top sectional view of the adapter.

Housing (12) further includes a first open end (14), and a second open end (16), as shown in FIG. 2. First end (14) is of a shape and size to accept and receive a first end cap (18) thereon. Second end (16) is of a shape and size to accept and receive a second end cap (20) thereon.

It is to be noted that end caps (18 & 20) may be of the type typically used on glass ferrule fuses. Each end cap (18 & 20) can be made from substantially any suitable material of engineering choice, such as metal, or the like, and both are of a shape and size to easily fit within a typical ferrule fuse clip (not shown).

Housing (12) further includes a first blade contact member (22) and a second blade contact member (24). First blade contact member (22) having a first end (26) and a second end (28). First end (26) is fixedly attached within first end cap (18), by any suitable attachment means of engineering choice, such as by soldering, or the like. Thus, first end (26) of blade contact member (22) and first end cap (18) provide electrical communication there between.

Second blade contact member (24) having a first end (30) and a second end (32). First end (30) is fixedly attached within second end cap (20), by any suitable attachment means of engineering choice, such as by soldering, or the like. Thus, first end (30) of blade contact member (24) and second end cap (20) provide electrical communication there between, and first blade contact member (22) and second blade contact member (24) are substantially spaced apart.

Second end (28) of first blade contact member (22), includes substantially a first elongated slot (34), which is of a shape and size to slidably receive a first terminal blade (36) of a typical prior art standard blade-type fuse (38) therein. Second end (28) further includes substantially a second elongated slot (40) which is of a shape and size to slidably receive a first terminal blade (42) of a typical prior art mini blade-type fuse (44) therein. It is to be noted that slot (34) is substantially longer and thinner than slot (40) and each slot (34 & 40), are in open communication with each other.

Second end (32) of second blade contact member (24), includes substantially a first elongated slot (34), which is of a shape and size to slidably receive a second terminal blade (48) of a typical prior art standard blade-type fuse (38) therein. Second end (32) further includes substantially a second elongated slot (50) which is of a shape and size to slidably receive a second terminal blade (52) of a typical prior art mini blade-type fuse (44) therein. It is to be noted that slot (46) is substantially longer and thinner than slot (50) and each slot (46 & 50), are in open communication with each other.

It is to be further noted that the adapter housing (12) can be manufactured with only slots (34 & 46) if so desired. Whereby, the adapter housing (12) will only accept a typical standard sized blade-type fuse. Or the housing (12) can be manufactured with only slots (40 & 50). Whereby, housing (12) will only accept a typical mini sized blade-type fuse.

It is to be understood that the present invention may be produced as described above, without a blown-fuse indicator light if so desired. As this invention is advantageous over the prior art because we can provide an adapter that accepts different sized fuses, unlike the prior art. However, the applicants feel the preferred adapter, namely an adapter having a blown-fuse indicator therein, is much more desirable, as described below.

Adapter housing (12) further includes a blown-fuse indicator light (54) therein, which can be any suitable indicator of engineering choice, and which provides a first terminal lead (56), and a second terminal lead (58), extending therefrom. First terminal lead (56) being substantially electrically connected to first blade contact member (22) and first end cap (18), at a location of engineering choice, by substantially any suitable attachment means of engineering choice, such as by soldering or the like. Second terminal lead (58) being substantially electrically connected to second blade contact member (24) and second end cap (20), at a location of engineering choice, by substantially any suitable attachment means of engineering choice, such as by soldering or the like.

Whereby, indicator light (54) will not illuminate if the fuse (60) of the blade fuse (38) is functional. However, indicator light (54) will illuminate if fuse (60) is not functional. Thus, visually notifying the user that blade fuse (38) must be replaced.

It will now be seen we have herein provided a ferrule-to-blade fuse adapter with a blown fuse indicator therein, which illuminates when the fuse has blown. Whereby, the user is visually notified that the fuse must be replaced.

It will further be seen we have herein provided a ferrule-to-blade fuse adapter with a blown fuse indicator therein, which can be manufactured to accept either a standard blade-fuse, a mini blade fuse, or both.

It will also be seen we have herein provided a ferrule-to-blade fuse adapter with a blown fuse indicator therein, that is most economical to manufacture, as well as easily marketable.

It will further be seen we have herein provided a ferrule-to-blade fuse adapter with a blown fuse indicator therein, that is most advantageous and provides most unusual results, not seen nor taught within the prior art.

Although the invention has been herein shown and described in what is conceived to be the most practical and preferred embodiment, it is recognized that departures may be made therefrom within the scope and spirit of the invention, which is not to be limited to the details disclosed herein but is to be accorded the full scope of the claims so as to embrace any and all equivalent devices and apparatus's.

What we claim as new and wish to secure by Letters Patent is:

1. Ferrule to blade fuse adapter comprising in combination: a cartridge-type adapter housing having slots which accept a mini-sized-blade-type fuse, and said adapter housing having a blown fuse indicator light, whereby:

when said mini-sized-blade-type fuse has blown, said light lights up and simultaneously illuminates the mini-sized-blade-type fuse housing, whereby:

a user is visually notified that said mini-sized-blade-type fuse has blown and replacement is necessary.

2. Ferrule to blade fuse adapter comprising: a cartridge-type adapter housing having slots which accept a standard sized blade-type fuse, and said adapter includes a blown fuse indicator light therein, whereby:

when said standard sized blade-type fuse has blown, said light lights up and simultaneously illuminates the standard sized blade-type fuse housing, whereby:

a user is visually notified that said standard sized blade-type fuse has blown and replacement is necessary.

3. Ferrule to blade fuse adapter comprising in combination: a cartridge-type adapter housing having slots which accept a mini-sized-blade-type fuse, said adapter housing having slots which accept a standard sized blade-type fuse, and said adapter housing having a blown fuse indicator light, whereby:

said adapter is removably attachable to either said standard sized blade-type, or said mini-blade-type fuse, whereby:

when said fuse has blown, said light lights up and simultaneously illuminates the fuse housing, whereby:

a user is visually notified that said fuse has blown and replacement is necessary.

* * * * *